United States Patent [19]

Malone

[11] Patent Number: 4,847,815

[45] Date of Patent: Jul. 11, 1989

[54] SINUSOIDAL PRESSURE PULSE GENERATOR FOR MEASUREMENT WHILE DRILLING TOOL

[75] Inventor: David Malone, Lafayette, La.

[73] Assignee: Anadrill, Inc., Sugar Land, Tex.

[21] Appl. No.: 99,817

[22] Filed: Sep. 22, 1987

[51] Int. Cl.[4] ..... G01V 1/40

[52] U.S. Cl. ..... 367/84

[58] Field of Search ..... 367/83, 84; 175/40, 175/48, 50; 73/151

[56] References Cited

U.S. PATENT DOCUMENTS

| | | | |
|---|---|---|---|
| Re. 29,734 | 8/1978 | Manning | 367/84 |
| 3,309,656 | 3/1967 | Godbey | 367/85 |
| 3,764,969 | 10/1973 | Cubberly, Jr. | 367/84 |

*Primary Examiner*—Thomas H. Tarcza
*Assistant Examiner*—Ian J. Lobo
*Attorney, Agent, or Firm*—Stephen L. Borst

[57] ABSTRACT

A pressure pulse generator which generates relatively sinusoidal pressure pulses in a fluid flowing in a borehole is disclosed. The pressure pulse generator for a MWD tool broadly comprises: a housing adapted to be connected in a tubing string so that fluid flowing in the string will at least partially flow through the housing; a stator mounted within the housing and having a plurality of lobes with intervening gaps; a rotor coaxial to the stator which rotates relative to the stator and which is mounted within the housing and has a plurality of lobes with intervening gaps between adjacent lobes, wherein the lobes of the rotor and stator are arranged such that as the rotor rotates relative to the stator, the area of the adjacent gaps between the lobes of the stator and rotor through which the fluid may flow in a direction parallel to the borehole varies approximately with the inverse of the square root of a linear function of a sine wave. Preferably, the geometrical arrangement of the stator and rotor are substantially identical with a plurality of lobes with intervening gaps around a central circular hub. A first side of each lobe is defined by a radial extension from the circular hub, and the second side of each lobe is substantially parallel to the first side.

19 Claims, 7 Drawing Sheets

OPEN POSITION

PARTIALLY OPEN

CLOSED

TOP VIEW

SINUSOIDAL PRESSURE PULSE GENERATOR FOR MEASUREMENT WHILE DRILLING TOOL

BACKGROUND

The present invention relates to pressure pulse generators such as the "mud siren" type used in oil industry measurement while drilling (MWD) operations. More particularly, the present invention relates to a modulator design for a MWD tool wherein sinusoidal pressure pulses are generated for transmission to the borehole surface by way of a mud column located in a drill string.

Many systems are known for transmitting data representative of one or more measured downhole conditions to a borehole surface during the drilling of the borehole. Typically, the systems employ a downhole pressure pulse generator or modulator which transmits modulated signals carrying encoded data at acoustic frequencies via the mud column in the drill string. Indeed, it is known to use coherent differential phase shift keyed modulation to encode the data, such that if a binary "one" is to be transmitted, the signal at the end of the sampling period is arranged to be one hundred and eighty degrees out of phase with the signal at the beginning of the period. If a binary zero is to be transmitted, the signal at the end of the period is arranged to be in phase with the signal at the beginning of the period.

In some of the known MWD tools of the art, the downhole electrical components are powered by a self-contained mud-driven turbine generator unit positioned downstream of the modulator. Thus, modulators of the mud siren type generally take the form of signal generating valves positioned in the drill string near the drill bit such that they are exposed to the circulating mud path. A typical modulator is comprised of a fixed stator and a motor-driven rotatable rotor positioned coaxially of each other. As seen in FIGS. 1*a*–1*c* and 2*a*–2*c*, the stator and rotor of the art are each formed with a plurality of block-like radial extensions or lobes spaced circumferentially about a central hub so that the gaps between adjacent lobes present a plurality of openings or ports which accommodate the oncoming flow stream of mud. As seen in FIGS. 1 and 2*a*, when the respective lobes and ports of the stator and rotor are in direct alignment (open position), they provide the greatest passageway for the flow of the mud through the modulator and hence the pressure drop across the modulator is small. When the rotor rotates relative to the stator as seen in FIG. 2*a*, alignment between the respective lobes and ports is shifted, thereby interrupting the flow of mud by causing it to divide as seen in FIG. 2*b*. Such an interruption causes the pressure drop across the modulator to rise. At a certain point, as seen in FIG. 1*c*, the lobes and ports of the stator and rotor take opposite positions (closed position) such that the flow of all the mud must follow a path through the modulator gap (as seen in FIG. 2*c*). Such an arrangement causes the pressure across the modulator to be a maximum. Thus, rotation of the rotor relative to the stator in the circulating mud flow produces a cyclic acoustic signal which travels up the mud column in the drill string and which may be detected at the drillsite surface. By selectively varying the rotation of the rotor to produce changes in the signal, a coherent differential phase shift keyed modulated pressure pulse may be achieved.

While pressure pulse generators employing rotors and stators provide MWD tools with a means for transmitting data, it has often been difficult to detect signals due to the weakness of the signals generated. The signal generated by the modulator is known to attenuate as the depth of the tool increases, and as the viscosity of the mud increases. Moreover, the only known manners of increasing signal strength are by increasing mud flow through the modulator, decreasing the flow area through the modulator, or by increasing mud density. Thus, it will be appreciated that the only known manner of increasing signal strength which may be affected by modulator flow design is to decrease the flow area of the modulator by reducing the modulator gap. However, reducing the modulator gap makes the modulator susceptible to jamming as circulation materials can become jammed between the rotor and stator. Jamming is costly as it typically stops the modulator rotation in the full closed position, thereby preventing circulation through the MWD tool and necessitating the removal of the tool from the borehole.

SUMMARY OF THE INVENTION

It is therefore an object of the invention to provide a modulator flow design for a MWD tool which increases the amplitude and power of the signal to be decoded.

It is a further object of the invention to provide a modulator for a MWD tool which increases the power of the signal to be decoded by generating a substantially sinusoidal signal.

It is yet a further object of the invention to provide a rotor and stator geometry for a MWD tool modulator which will generate a substantially sinusoidal signal when the rotor moves relative to the stator.

According to the invention, a pressure pulse generator for generating pulses in fluid flowing in a borehole broadly comprises:

(a) a housing adapted to be connected in a tubing string so that fluid flowing in the string will at least partially flow through the housing;

(b) a stator mounted within the housing and having a plurality of lobes with intervening gaps between adjacent lobes serving to present a plurality of ports for the passage of fluid flowing through the housing; and (c) a rotor mounted within the housing and coaxial to the stator, and having a plurality of lobes with intervening gaps between adjacent lobes serving to present a plurality of ports for the passage of fluid flowing through the housing, wherein the rotor rotates relative to the stator, and wherein the lobes of the rotor and stator are arranged such that as the rotor rotates relative to the stator, the area of the adjacent gaps between the lobes of the stator and rotor through which the fluid may flow in a direction parallel to the borehole varies approximately with the inverse of the square root of a linear function of a sine wave.

By arranging the stator and rotor in the manner described, the pressure over the modulator will vary according to a sine wave. In order to provide the same, the geometrical arrangement of the stator and rotor are preferably identical. The stator and rotor preferably include a plurality of lobes with intervening gaps around a central circular hub, with a first side of each lobe defined by a radial extension from the circular hub, and with the second side of each lobe being substantially parallel to the first side. The outside edges of the lobes are preferably located along a circle concentric with the circular hub. While the gaps between the lobes are not definable in relation to sectors of the circular hub, the angle defined by the axis though the origin of the circular hub, the intersection of the first side of a lobe and the outer edge, and the intersection of the second side of the same lobe and the outer edge preferably extends thirty degrees (where six lobes are present). Likewise, the angle defined by the hub axis, the intersection of the first side of a lobe and the outer edge, and the intersection of the second side of an adjacent lobe and the outer edge preferably extends thirty degrees (for six lobes).

Other objects, features, and advantages of the invention will become apparent to those skilled in the art upon reference to the following detailed description of the invention and the accompanying drawings.

DETAILED DESCRIPTION OF THE PREFERRED EMBODIMENT

Figure 3A:
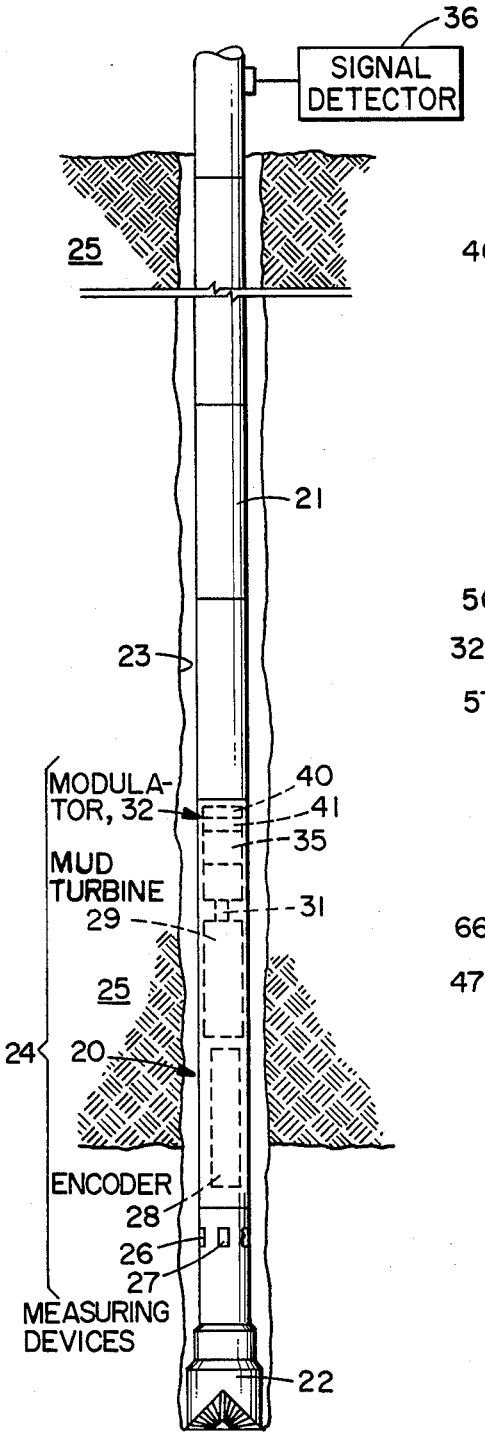
FIG. 3*a* is a schematic view of a pressure pulse generator in accordance with the invention, shown coupled in a drill string of a typical MWD drilling operation.

FIG. 3*a* of the drawings shows a tubular MWD tool 20 connected in a tubular drill string 21 having a rotary drill bit 22 coupled to the end thereof and arranged for drilling a borehole 23 through earth formations 25. As the drill string 21 is rotated by a conventional drilling rig (not shown) at the formation surface, substantial volumes of a suitable drilling fluid (i.e. "drilling mud") are continuously pumped down through the drill string 21 and discharged from the drill bit 22 to cool and lubricate the bit and to carry away earth cuttings removed by the bit. The mud is returned to the top of the borehole along the annular space existing between the walls of the borehole 23 and the exterior of the drill string 21. The circulating mud stream flowing through the drill string 21 may serve, if desired, as a medium for transmitting pressure pulse signals carrying information from the MWD tool 20 to the formation surface.

A downhole data signaling unit 24 has transducers mounted on the tool 20 that take the form of one or more condition responsive devices 26 and 27 coupled to appropriate circuitry, such as encoder 28, which sequentially produces encoded digital data electrical signals representative of the measurements obtained by the transducers 26 and 27. The transducers 26 and 27 are selected and adapted as required for the particular application to measure such downhole parameters as the downhole pressure, the downhole temperature, and the resistivity or conductivity of the drilling mud or adjacent earth formations, as well as to measure various other downhole conditions similar to those obtained by present day wireline logging tools.

Electrical power for operation of the data signaling unit 24 is provided by a typical rotatably-driven axial flow mud turbine 29 which has an impeller 30 responsive to the flow of drilling mud that drives a shaft 31 to produce electrical energy.

The data signaling unit 24 also includes a modulator 32 which is driven by a motor 35 to selectively interrupt or obstruct the flow of the drilling mud through the drill string 21 in order to produce digitally encoded pressure pulses in the form of acoustic signals. The modulator 32 is selectively operated in response to the data encoded electrical output of the encoder 28 to generate a correspondingly encoded acoustic signal. This signal is transmitted to the well surface by way of the fluid flowing in the drill string 21 as a series of pressure pulse signals which preferably are encoded binary representations of measurement data indicative of the downhole drilling parameters and formation conditions sensed by transducers 26 and 27. When these signals reach the surface, they are detected, decoded and converted into meaningful data by a suitable signal detector 36, such as shown in U.S. Pat. No. 3,309,656; 3,764,968; 3,764,969; and 3,764,970.

The modulator 32 includes a preferably fixed stator 40 and a rotatable rotor 41 which is driven by the motor 35 in response to signals generated by the encoder 28. Rotation of the rotor 41 is controlled in response to the data encoded electrical output of the encoder 28 in order to produce a correspondingly encoded acoustic output signal. This can be accomplished by applying well-known techniques to vary the direction or speed of the motor 35 or to controllably couple/uncouple the rotor 41 from the drive shaft of the motor 35.

As will be described in greater detail hereinafter, the stator 40 of the invention has a plurality of evenly-spaced block-like lobes 71 circumferentially arranged about a central hub. The gaps between adjacent lobes 71 provide a plurality of ports in the stator through which incident drilling mud may pass as jets or streams directed more or less parallel to the stator hub axis. Also, as will be described in greater detail hereinafter, the rotor 41 has a similar configuration to that of the stator. The rotor 41 is preferably positioned coaxial to and adjacent to the stator 40 such that the rotor may rotate about an axis coaxial with the hub axis of the stator. As the rotor 41 is rotated, its lobes 72 successively move into and out of positions obstructing the flow of the drilling mud through the ports of the stator. In this manner, pressure pulse signals are produced and transmitted upstream in the circulating mud.

When the rotor 41 is rotated in relation to the stator 40 so as to momentarily present the greatest flow obstruction to the circulating mud stream, the resulting acoustic signal will be at its maximum amplitude. As the rotor 41 continues to rotate, the amplitude of the acoustic signal produced by the modulator 32 will decrease from its maximum to its minimum value as the rotor moves to a position in which it presents the least obstruction to the mud flow. Further rotor rotation will cause a corresponding increase in signal amplitude as the rotor again approaches its next maximum flow obstruction position.

Those skilled in the art will recognize that rotation of the modulator rotor 41 will produce an acoustic output signal having a cyclic waveform with successively alternating positive and negative peaks referenced about a mean pressure level. Continuous rotation of the rotor 41 will produce a typical alternating or cyclic signal at a designated frequency which will have a determinable phase relationship in relation to some other alternating signal, such as a selected reference signal generated in the circuitry of the signal detector 36. By momentarily advancing, retarding, stopping or reversing the rotation of the rotor 41 in response to outputs from the encoder 28, the rotor can be selectively shifted to a different position vis-a-vis the stator 40 than it would have occupied had it continued to rotate without change. This selective shifting causes the phase of the acoustic signal to shift relative to the phase of the reference signal. Such controlled phase shifting of the signal generated by the modulator 32 acts to transmit downhole measurement information by way of the mud column to the borehole surface or detection by the signal detector 36. A shift in phase at a particular instance signifies a binary bit "1" (or "0", as desired) and absence of a shift signifies a binary bit "0" (or "1"). Other signal modulation techniques are usable, and selection of the specific encoding, modulation and decoding schemes to be employed in connection with the operation of the modulator 32 are matters of choice, detailed discussion of which is unnecessary to an understanding of the present invention.

Figure 3B:
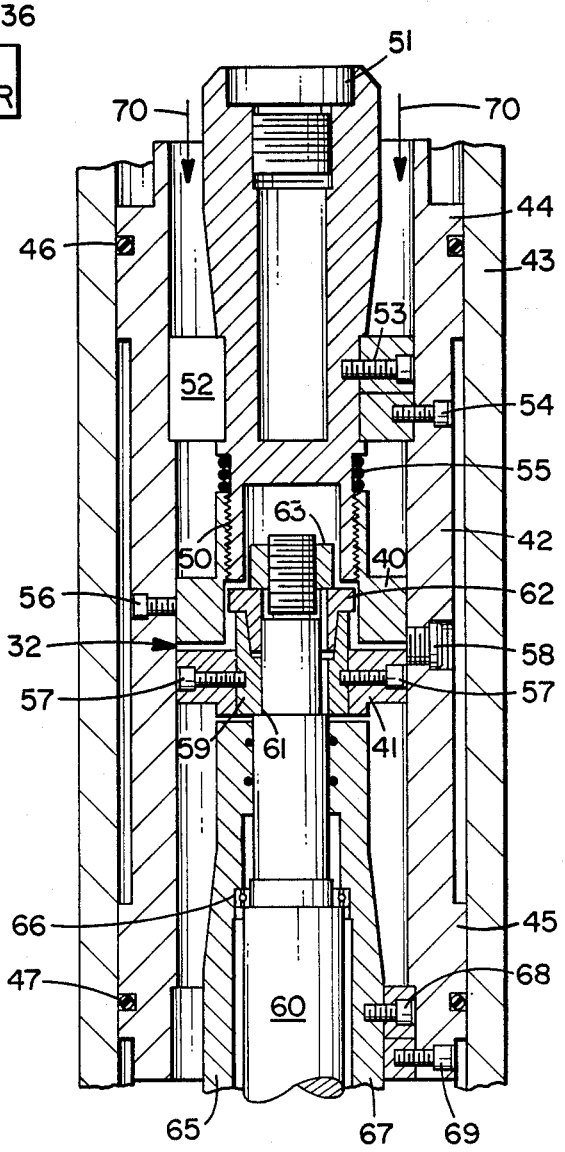
FIG. 3*b* is a side view, in partial section, of the generator of FIG. 3*a;*

As shown in FIG. 3*b*, both the stator 40 and the rotor 41 are mounted within a tubular housing 42 which is force fitted within a portion of a drill collar 43 by means of enlarged annular portions 44 and 45 of the housing 42 which contact the inner surface of the drill collar 43. A plurality of O-rings 46 and 47 provide sealing engagement between the collar 43 and the housing 42. The stator 40 is mounted by way of threaded connections 50 to an end of a supporting structure 51 centrally located within the housing 42 and locked in place by a set screw 56. The space between the end of the threaded portion of the stator 40 and an adjacent shoulder of the supporting structure 51 is filled with a plurality of O-rings 55. The supporting structure 51 is maintained in spaced relationship to the inner walls of the housing 42 by means of a front standoff or spider 52. The standoff 52 is secured to the supporting structure 51 by way of a plurality of hex bolts 53 (only one of which is shown) and, in turn, secured to the housing 42 by a plurality of hex bolts 54 (only one of which is shown). The front standoff 52 is provided with a plurality of spaced ports to permit the passage of drilling fluid in the annular space formed between the supporting structure 51 and the inner walls of the housing 42.

The rotor 41 is mounted for rotation on a shaft 60 of the motor 35 (of FIG. 3*a*) which drives the rotor 41. The rotor 41 has a rotor bushing 59 keyed near the end of the shaft 60 and forced into abutment with a shoulder 61 of the shaft 60 by a bushing 62 also keyed to the end of the shaft 60. The bushing 62 is forced against the rotor bushing 59 by means of a hex nut 63 threaded to the free end of the shaft 60. An inspection port 58 is provided for examining the stator and rotor lobes 71, 72 to measure rotor-stator spacing and to detect wear.

The shaft 60 is supported within a bearing housing 65 for rotation about a bearing structure 66. The bearing housing 65 is supported in spaced relationship to the inner walls of the housing 42 by way of rear standoff or spider 67 secured to the bearing housing by way of hex bolts 68 and, in turn, secured to the housing 42 by way of hex bolts 69.

Figure 3C:
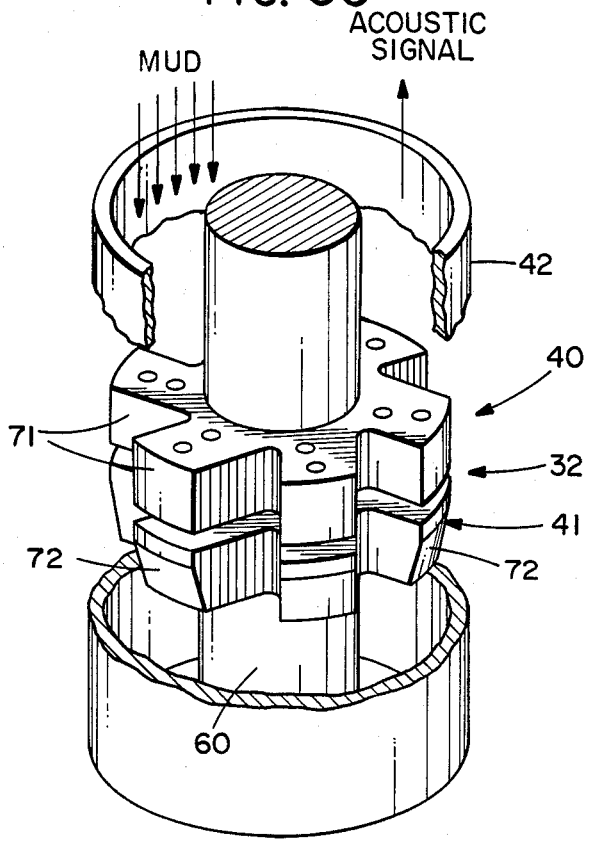
FIG. 3*c* is a perspective view of the pressure pulse modulator of FIG. 3*a;*

As indicated by FIGS. 3*b* and 3*c*, drilling fluid flows into the top of the housing 42 in the direction of arrows 70 through the annular space between the external wall of the supporting structure 51 and the inner walls of the housing 42 and flows through ports of the stator 40 and the rotor 41. The fluid flow continues past the rear standoff 67 and on to the drill bit 22. The shaft 60 drives the rotor 41 to interrupt the fluid jets passing through the ports of the stator 40 to generate a coded acoustic signal that travels upstream.

In accordance with the invention, the rotor 41 may be positioned either upstream or downstream of the stator 40, as desired, provided that an acoustic signal is transmitted uphole. As will be discussed in detail hereinafter, the stator and rotor 41 are each provided with a plurality of lobes 71 and 72 which extend from coaxial central hubs of the stator and rotor. The lobes 71 of the stator 40 are identically constructed, and the lobes 72 of the rotor 41 are identically constructed. In addition, the shape of the lobes 71 of the stator 40 is substantially similar to the shape of the lobes 72 of the rotor 41, and the same number of lobes is used for the stator and the rotor. The lobes are generally defined by a top (upstream surface), a bottom (downstream surface), sides (surfaces extending from the hub that join the top and bottom), and an outer edge (surface furthest from and substantially concentric with the hub). If desired, for rigidity, either one or both of the stator 40 and rotor 41 may be provided with a rim that circumscribes the outer edge of the lobes. Also, if desired, the stator 40 may be formed integrally with the housing 42.

Before discussing in detail the geometry of the lobes of the stator 40 and rotor 41, a basic understanding of the theory behind the geometry is warranted. As stated in the Background section herein, signal detection with MWD tools has often been difficult due to the weakness of the signals generated. However, to date, the only known manners of increasing signal strength are by increasing mud flow through the modulator, decreasing the flow area through the modulator, or by increasing mud density, only the second of which may be affected by modulator flow design. Indeed, the three manners of increasing signal strength are found in the relationship:

$$\text{Sig} \propto PQ^2/A^2 \qquad (1)$$

where Sig is the signal pressure, Q is the mud flow rate, p is the mud density, and A is the modulator flow area. Of course, reducing the modulator gap is not always desirable as it makes the modulator susceptible to jamming as circulation materials can become jammed between the rotor and stator. Thus, it is desirable to increase the signal amplitude in a heretofore unknown manner.

Figure 1A:
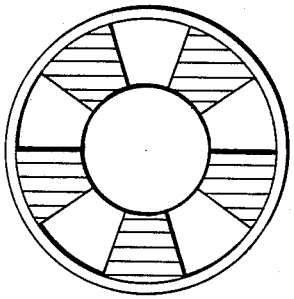
PRIOR ART FIG. 1A
FIGS. 1*a*–1*c* are top view diagrams of the stator and rotor of the prior art showing open, partially open, and closed positions.
Figure 1B:
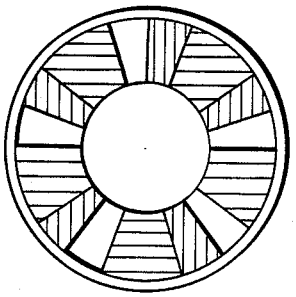
Figure 1C:
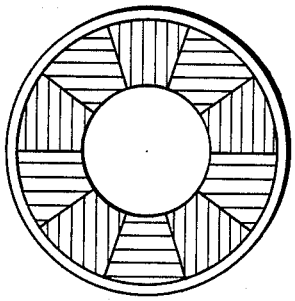
Figure 2A:
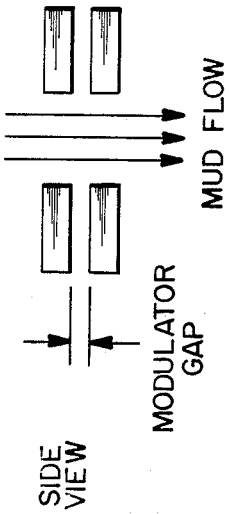
FIGS. 2*a*–2*c* correspond to FIGS. 1*a*–1*c* and are side view schematic diagrams of the mud flow through the stator and rotors of the prior art.
Figure 2B:
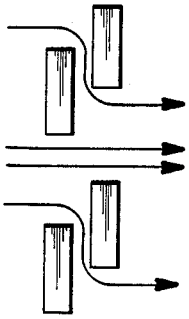
Figure 2C:
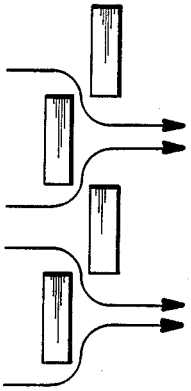
Figure 4B:
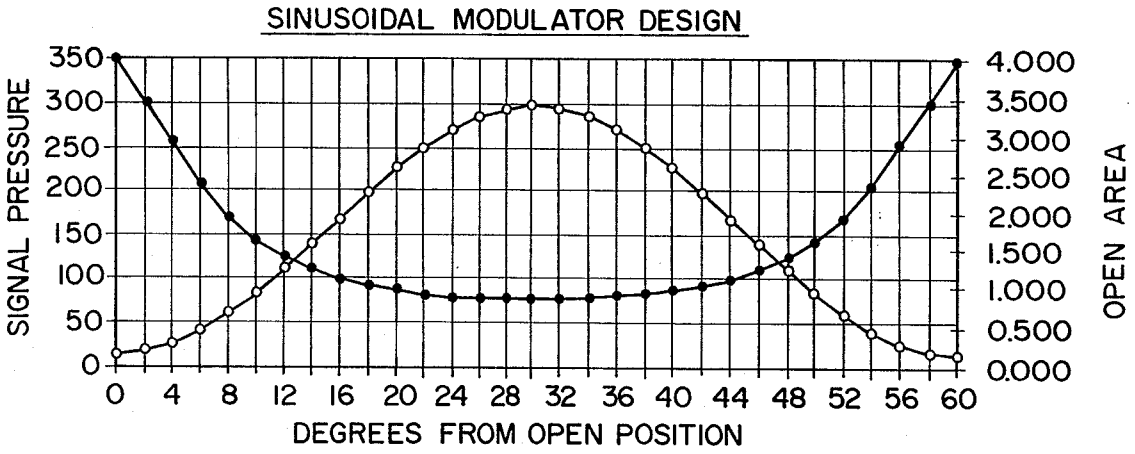
FIGS. 4*a* and 4*b* are graphs relating the signal pressure and open area resulting from the rotational position of the prior art modulator and the modulator of the invention respectively.
Figure 4A:
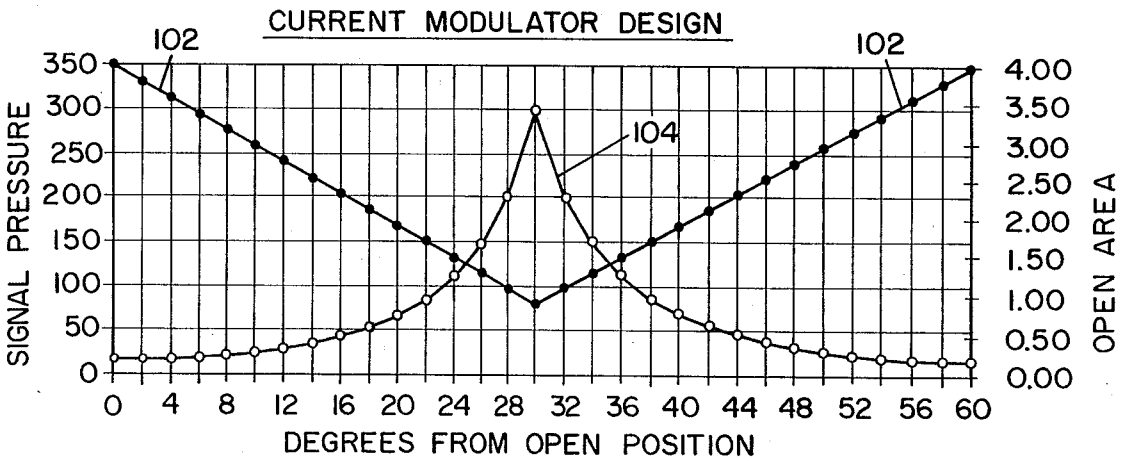

The inventor has recognized that while the absolute magnitude of the signal cannot be changed, the harmonic distribution of the signal can be changed. Thus, the inventor has recognized that with the stator and rotor arrangements of the prior art (as seen FIGS. 1*a*–1*c*), the area of opening between the stator and rotor varies linearly with rotation. With a constant speed of rotation, the signal amplitude (or signal pressure) takes the form of a peaked wave, with the peak occurring where the area is at a minimum. This signal amplitude wave is seen in FIG. 4*a*, where the signal pressure and the open area between the rotor and stator are plotted versus the degrees from the open position of FIG. 1*a*. At the open position where the area is the greatest, the pressure is the lowest. As the rotor closes relative to the stator, the open area which is represented by line 102 falls off linearly. Meanwhile the pressure, which is represented by line 104, rises as a function of the inverse of the square of the area. When the rotor is closed relative to the stator as indicated by FIG. 1 the open area is at a minimum, and the pressure is at a maximum. It should be noted that the pressure never rises to infinity even when the rotor and stator are in a closed position, as mud will always flow through the gap between the rotor and stator. Thus, the "open area" as seen in FIG. 4*a*, never reaches zero.

Figure 5A:
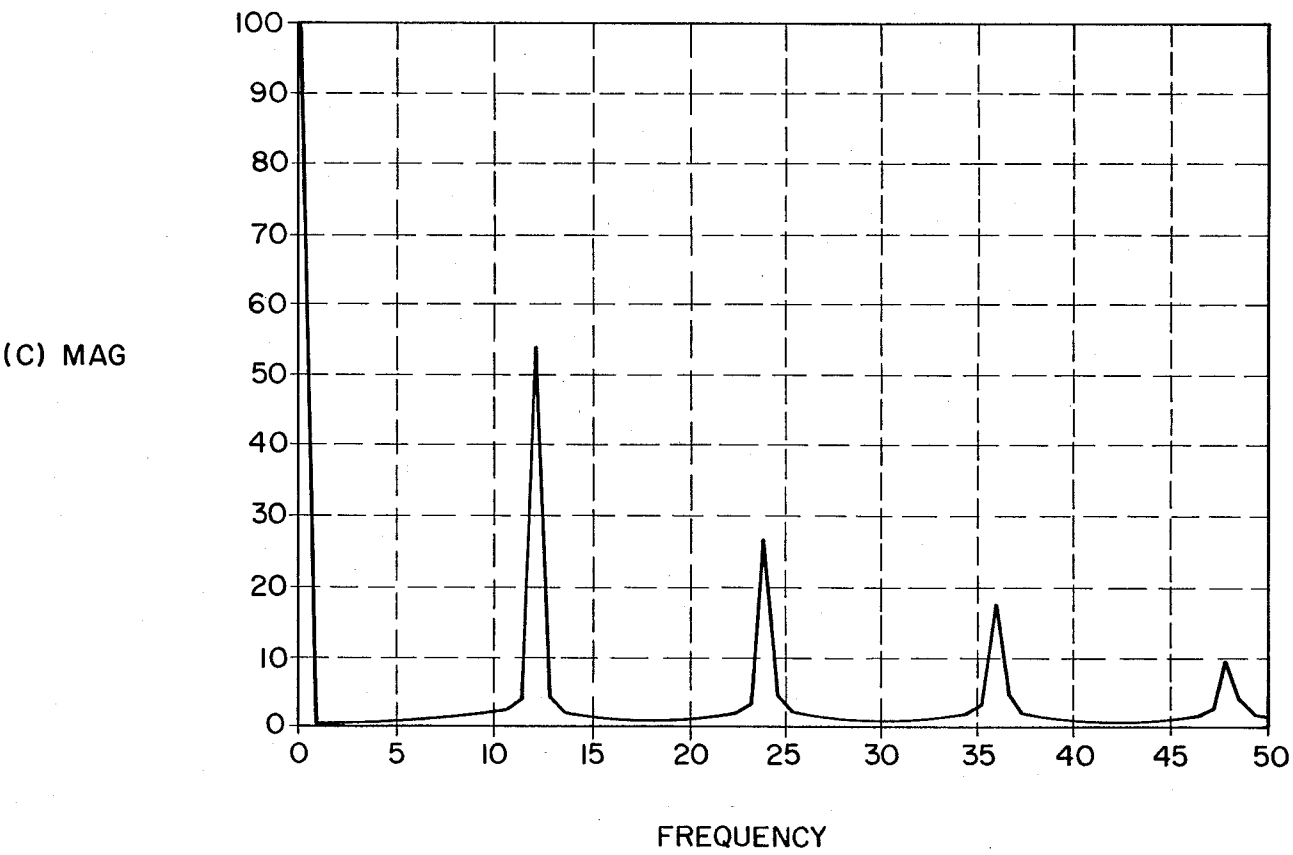
FIGS. 5*a* and 5*b* are amplitude versus frequency plots for the modulator of the prior art and the modulator of the invention respectively.
Figure 5B:
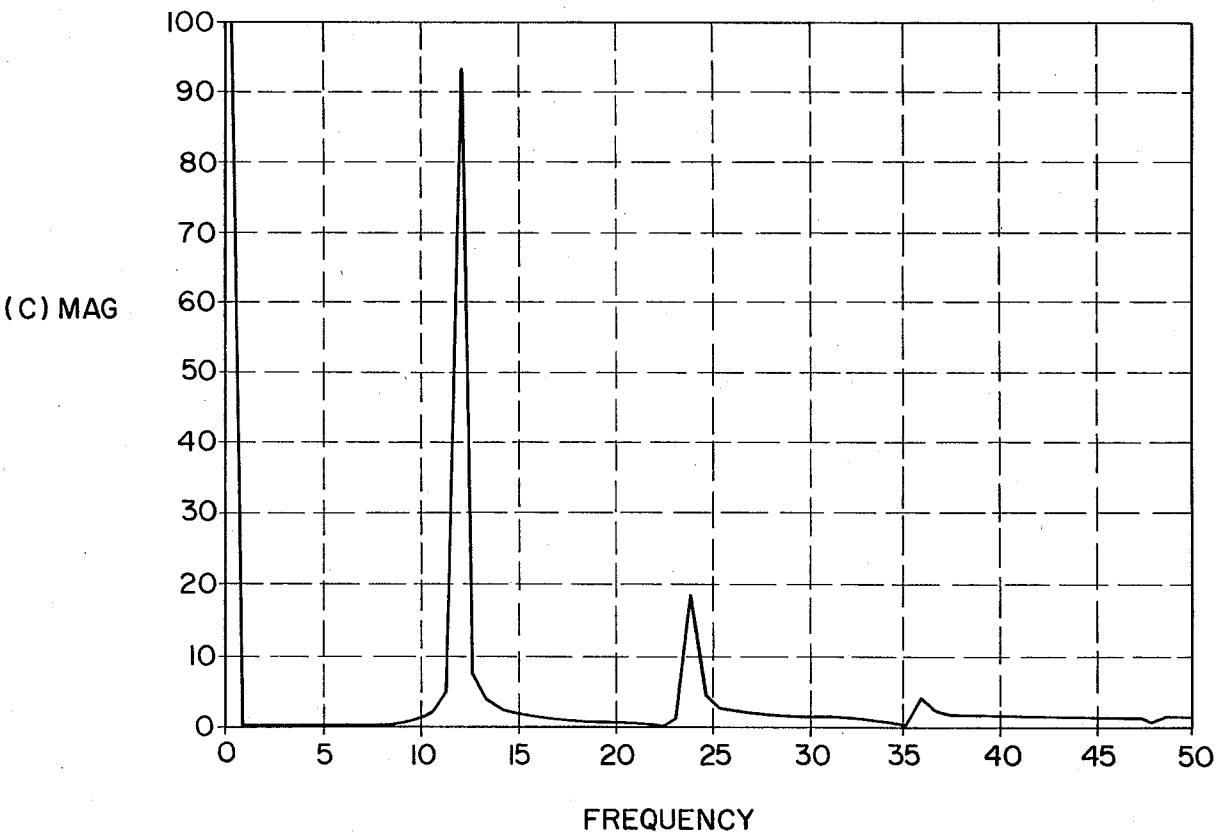
Figure 6A:
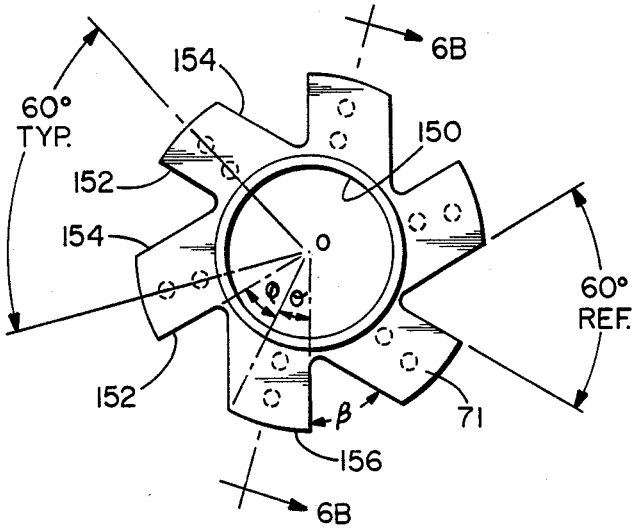
FIG. 6*a* is a top plan view of the stator of the modulator of the invention.
Figure 6B:
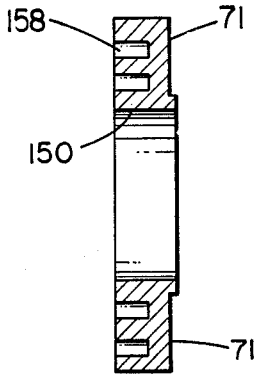
FIG. 6*b* is a sectional view of the stator as seen from line 6*b*–6*b* of FIG. 6*a;*

With the pressure wave of the prior art as shown in FIG. 4*a*, and with the modulator of the prior art arranged to move the rotor relative to the stator to provide a twelve Hz carrier frequency, it can be shown that only a portion of the pressure wave signal is transmitted at the 12 Hz frequency. The remainder of the energy is dissipated into higher harmonic frequencies. Thus, as seen in FIG. 5*a* which plots signal amplitude versus frequency (and which was generated by conducting a fast Fourier transform on the data used to generate FIG. 4*a*), while the twelve Hz peak of a typical modulator of the art might have a relative magnitude of 50 PSI with the wave shown in FIG. 4*a*, over half of the pressure wave energy is found in energy peaks of harmonic frequencies of twenty-four, thirty-six and forty-eight Hz.

In order to locate as much energy as possible into a single frequency peak, it is preferable to arrange the lobes of the rotor and stator such that as the rotor rotates relative to the stator, the area through which the fluid may flow in a direction parallel to the borehole varies approximately with the inverse of the square root of a linear function of a sine wave. Such an arrangement should provide a sinusoidal pressure signal with all of the energy at one frequency. This may be understood as follows. In accord with equation (1) above, the signal pressure is proportional to the inverse of the square of the area of the gaps. If the area of the gaps (A) varies over time with the inverse of the square root of a linear function of a sine wave, such that $$A(t) \alpha 1/(K+a \sin wt)^{\frac{1}{2}} \quad (2)$$

where a is a function of the amplitude (e.g. a=twice the amplitude) of the sine wave, W is the frequency of the sine wave, K is a constant (e.g. K=offset+a/2) and t is time, the pressure will vary as:

$$P(t) \alpha 1/(A(t))^2 \alpha K+a \sin wt \quad (3)$$

If the frequency of the sine wave at which the pressure varies is arranged to be the carrying frequency, ideally all the energy of the sine wave will fall at that frequency. Thus, the effective amplitude of the signal will rise significantly. It should be noted the constant K is included so that the pressure across the modulator will never be zero and thereby necessitate an infinite area according to equation (1). Also, in the absence of K, the value for the area A would become infinite when sin $W=n\pi$, where n is an integer. It will be appreciated that in a positive pressure system, the pressure offset is positive and the amplitude a/2 is positive such that the measured pressure over time will vary as a sine wave above the offset value, i.e. offset+a/2 (1+sin wt), where a/2 (1+sin wt) varies from 0 to a. In a negative pressure system, the offset is positive and the amplitude a/2 is negative such that the measured pressure over time will vary as a sine wave below the offset value.

In creating a rotor and stator having a geometry which provides gaps that vary with the inverse of the square root of a linear function of a sine wave as the rotor rotates, it was found that one arrangement approaching the same is to provide lobes for both the rotor and stator with a first side of each lobe defined by a radial extension from the circular hub, and with the second side of each lobe being substantially parallel to the first edge. In order to provide the situation where the rotor and stator are not in a relatively open or closed position for more than an instant, the rotor and stator were arranged such that the angle defined by the origin of said circular hub, the intersection of a first side of a lobe and the outer edge, and the intersection of the second side of the same lobe and the outer edge was substantially equal to the angle defined by the origin of the circular hub, the intersection of the first side of a lobe and the outer edge, and the intersection of the second side of an adjacent lobe and the outer edge.

The stator and rotor provided according to the stated geometry are seen in FIGS. 6*a*, 6*b*, and 7*a* and 7*b* respectively. Extending in a radial fashion from the stator hub 150 are first sides 152 of the lobes 71. The first sides 152 are preferably located at sixty degree intervals around the hub 150, so that six lobes 71 may be provided. The second side 154 of each lobe 71 is preferably parallel to the first side 152. The angle $\theta$ formed by the origin O, and the points defined by the intersection of the outer edge 156 of the lobe 71 and the first and second sides 152 and 154, is preferably thirty degrees. Likewise, the angle $\phi$ formed by the origin O and the points defined by the intersection of the outer edge 156 and first side of one lobe and the intersection of the outer edge 156 and the second side of an adjacent lobe is also preferably thirty degrees. Also, preferably, the angle $\beta$ defined by the first side of one lobe, the second side of an adjacent lobe, and the point on the circumference of the hub 150 where the two sides meet circumscribes sixty degrees. As may be seen with reference to FIG. 6*b*, each stator lobe 71 includes threaded bores 158 which receive bolts which serve to mount the stator to a stator support fixture (not shown). The stator support fixture, in turn, mounts the stator to the tool.

Figure 7A:
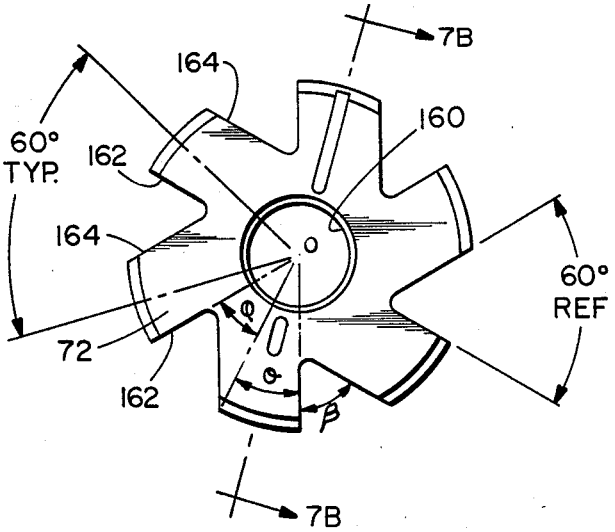
FIG. 7*a* is a top plan view of the rotor of the modulator of the invention.
Figure 7B:
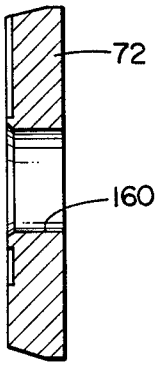
FIG. 7*b* is a sectional view of the rotor as seen from line 7*b*–7*b* of FIG. 7*a.*

Turning to FIGS. 7*a* and 7*b*, it will be seen that the rotor geometry is much the same as the stator geometry. Thus, extending in a radial fashion from the rotor hub 160 are first sides 162 of the lobes 72. The first sides 162 are preferably located at sixty degree intervals around the hub 160, so that six lobes 72 may be provided. The second side 164 of each lobe 72 is preferably parallel to the first side 162. The angle $\theta$ formed by the origin O, and the points defined by the intersection of the outer edge 166 of the lobe 72 and the first and second sides 162 and 164, is preferably thirty degrees. Likewise, the angle $\phi$ formed by the origin O and the points defined by the intersection of the outer edge 166 and first side of one lobe and the intersection of the outer edge 166 and the second side of an adjacent lobe is also preferably thirty degrees. Also, preferably, the angle $\beta$ defined by the first side of one lobe, the second side of an adjacent lobe, and the point on the circumference of the hub 160 where the two sides meet circumscribes sixty degrees.

Dimensions of the example rotor 41 and stator 40 shown in FIGS. *6a* and *7a*, might be:

STATOR 40

Number of lobes=6
Outside diameter=3.804"
Depth=0.630"
Hub diameter=1.845"

ROTOR 41

Number of lobes=6
Outside diameter=3.920"
Depth=0.625"
Hub diameter=1.125"

With a modulator built from the rotor and stator as provided above, the signal pressure provided is seen in FIG. *4b*. The open area of the modulator may be shown to be generally inversely related to the square root of a linear function of a sine wave, and provides a signal pressure which is substantially sinusoidal in relation to a constant relative rotational movement of the rotor and stator. With the generally sinusoidal signal pressure, it will be appreciated that a large percentage of the energy of the pressure wave falls within a single frequency. Thus, as seen in FIG. *5b*, the energy of the modulator of the invention is graphed as a function of frequency, with the twelve Hz frequency having a relative magnitude of over 90 PSI. The second and third harmonics are seen to have a much smaller magnitude, with higher harmonics being almost nonexistent. In comparison to the prior art, it will be appreciated that the modulator of the invention provides a useful signal almost twice the amplitude of the prior art. Hence, the power of the signal using the modulator of the invention is almost four times the power of the standard modulator.

The advantages of having a modulator which provides a signal of four times the power or twice the amplitude are well known to those skilled in the art. With a stronger signal, the modulator gap can be increased, thereby decreasing jamming tendencies and vibration and impact loading of the tool. Also, with a stronger useful signal, the depth over which an MWD tool may be useful can be increased by about 4000 feet in an average well, as the increased signal strength permits signal detection at greater depths.

It will be appreciated that particular aspects of the modulator of the invention may be altered to conform with other advances in the art. For example, as taught in copending Ser. No. 924,171, the sides of the rotor may be outwardly tapered in the downstream direction. In this manner, should the generator fail, fluid forces will urge the generator into a position of minimum flow blockage Likewise, by providing rotor lobes with sides having a reduced width untapered region at their trailing edges adjacent to bottom surface of the lobe, an aerodynamic flutter can be created to prevent debris from blocking the flow of fluid through the modulator.

There has been described and illustrated herein a modulator for a MWD tool. While particular embodiments of the invention have been described, it is not intended that the invention be limited thereby, as it is intended that the invention be broad in scope and that the specifications be read likewise. Thus, it should be appreciated that while a particular embodiment of the rotor and stator has been described, with the rotor and stator having a plurality of lobes with a first side of each lobe defined by a radial extension from a circular hub, and with the second side of the lobe being substantially parallel to said first side, other arrangements which provide an area for fluid flow which varies approximately with the inverse of the square root of a linear function of a sine wave are intended to be encompassed by the invention. For example, one or both sides of the lobe could be slightly curved. Or, with a rotor and stator in accord with FIGS. 1a–1c where the openings vary linearly with rotation, a flow area which varies approximately with the inverse of the square root of a linear function of a sine wave over time could be provided by supplying means for appropriately varying the speed of rotation of the rotor. Also, while a particular arrangement for a MWD tool employing a rotor and stator has been described, those skilled in the art will appreciate that the MWD tool may take other forms without deviating from the teachings of the invention. For example, poppet valves which are known in the art, as well as positive and negative pressure pulse systems known in the art (as disclosed e.g., in U.S. Pat. Nos. 3,756,076 to Quichaud et al., 4,351,037 to Scherbatskoy, and 4,630,244 to Larronde) could be employed provided the opening through which the fluid flows is restricted in a manner which varies with the inverse of the square root of a linear function of a sine wave.

It will be further appreciated that details of the rotor and stator modulator described herein may also be altered while staying within the scope of the invention. Thus, decisions such as whether to taper the lobes, whether to place the rotor upstream or downstream of the stator, etc., are design decisions made according to considerations beyond the scope of the invention. Therefore, it will be apparent to those skilled in the art that other changes and modifications may be made to the invention as described in the specification without departing from the spirit and scope of the invention as so claimed.

I claim:

1. A pressure pulse generator for generating pulses in a fluid flowing in a conduit, comprising:

(a) a housing adapted to be placed into said fluid flowing in said conduit such that said flowing fluid will at least partially flow through said housing;

(b) orifice defining means within said housing, for restricting the area through which said fluid may flow through said housing, wherein said orifice defining means defines an orifice having an area which varies in time substantially with the inverse of the square root of a linear function of a sine wave.

2. A pressure pulse generator according to claim 1, wherein:

said orifice defining means which varies the orifice area (A) in time (t) substantially with the inverse of the square root of a linear function of a sine wave, varies the orifice area according to $$A(t)=1/(K+a\sin wt)^{\frac{1}{2}}$$

where a is a function of the amplitude of the sine wave, w is the frequency of the sine wave, and K is a constant.

3. A pressure pulse generator according to claim 2, where the fluid flowing in said conduit flows through said housing in a first direction and at a first pressure, and flows through said conduit outside said housing in a second direction and at a second relatively lower pressure, wherein:

said orifice defining means within said housing restricts the flow of fluid flowing through said housing in said first direction, such that when said fluid passes through said orifice defining means, it continues flowing in said first direction.

4. A pressure pulse generator according to claim 3, wherein:

the amplitude of said sine wave is a/2, and K is set to a/2+ O where O is an offset value, and the amplitude a/2 is a positive value.

5. A pressure pulse generator according to claim 2, where the fluid flowing in said conduit flows through said housing in a first direction and at a first pressure, and flows through said conduit outside said housing in a second direction and at a second relatively lower pressure, wherein:

said orifice defining means extends through said housing and connects said fluid flowing through said housing in a first direction with said fluid flowing in said second direction.

6. A pressure pulse generator according to claim 5, wherein:

the amplitude of said sine wave is a/2, and K is set to a/2+ O where O is an offset value, and the amplitude a/2 is a negative value.

7. A pressure pulse generator according to claim 4, where said conduit is a borehole, and wherein:

said orifice defining means includes a stator mounted within the housing and having a plurality of lobes with intervening gaps between adjacent lobes serving to present a plurality of ports for the passage of fluid flowing through the housing, and a rotor mounted coaxial to the rotor within the housing and having a plurality of lobes with intervening gaps between adjacent lobes serving to present a plurality of ports for the passage of fluid flowing through the housing, wherein the rotor rotates relative to the stator, and wherein the lobes of the rotor and stator are arranged such that as the rotor rotates relative to the stator, the area of the adjacent gaps between the lobes of the stator and rotor through which the fluid may flow in a direction parallel to the borehole varies approximately with the inverse of the square root of a linear function of a sine wave.

8. A pressure pulse generator according to claim 7, where said rotor rotates at a substantially constant speed relative to said stator, wherein:

said stator and said rotor preferably each include a plurality of lobes with intervening gaps around a central circular hub, with a first side of each lobe defined by a radial extension from said circular hub, and with the second side of each lobe being substantially parallel to said first side.

9. A pressure pulse generator for generating pulses in fluid flowing in a borehole, comprising (a) a housing adapted to be connected in a tubing string so that fluid flowing in the string will at least partially flow through the housing;

(b) a stator mounted within the housing and having a plurality of lobes with intervening gaps between adjacent lobes serving to present a plurality of ports for the passage of fluid flowing through the housing; and (c) a rotor mounted coaxial to the rotor within the housing and having a plurality of lobes with intervening gaps between adjacent lobes serving to present a plurality of ports for the passage of fluid flowing through the housing, wherein the rotor rotates relative to the stator, and wherein the lobes of the rotor and stator are arranged such that as the rotor rotates relative to the stator, the area of the adjacent gaps between the lobes of the stator and rotor through which the fluid may flow in a direction parallel to the borehole varies approximately with the inverse of the square root of a linear function of a sine wave.

10. A pressure pulse generator according to claim 9, wherein:

the geometrical arrangement of said stator and said rotor are substantially identical.

11. A pressure pulse generator according to claim 9, wherein:

said stator and said rotor preferably each include a plurality of lobes with intervening gaps around a central circular hub, with a first side of each lobe substantially defined by a radial extension from said circular hub, and with the second side of each lobe being substantially parallel to said first side.

12. A pressure pulse generator according to claim 11, wherein:

the outside edges of said lobes are preferably located substantially along a circle concentric with the circular hub.

13. A pressure pulse generator according to claim 12, wherein:

the angle defined by the origin of said circular hub, the intersection of a first side of a lobe and the outer edge, and the intersection of the second side of the same lobe and the outer edge is substantially equal to the angle defined by the origin of the circular hub, the intersection of the first side of a lobe and the outer edge, and the intersection of the second side of an adjacent lobe and the outer edge.

14. A pressure pulse generator according to claim 13, wherein:

said rotor and said stator each have six lobes, and said substantially equal angles are equal to thirty degrees.

15. A pressure pulse generator according to claim 14, wherein:

said rotor and said stator each have five lobes, and said substantially equal angles are equal to thirty-six degrees.

16. A pressure pulse generator according to claim 15, wherein:

the area (A) of the adjacent gaps between the lobes of the stator and rotor through which the fluid may flow in a direction parallel to the borehole varies in time (t) substantially according to $$A(t)=1/(K+a\sin wt)^{\frac{1}{2}}$$

where a is a function of the amplitude of the sine wave, w is the frequency of the sine wave, and K is a constant.

17. A pressure pulse generator according to claim 16, wherein:

the amplitude of said sine wave is a/2, and K is set to a/2+ O where O is an offset value, and the amplitude a/2 is a positive value.

18. A pressure pulse generator of the type used for communicating information between point of a wellbore, comprising:

(a) a tubular conduit within said wellbore for conducting flowing fluid therethrough;

(b) means mounted on said conduit for modulating flow area of said fluid with respect to time in a nonlinear manner so as to produce in said flowing fluid substantially sinusoidal preferred frequency with a minimum of energy at other frequencies including harmonics of said preferred frequency.

19. The pressure pulse generator as recited in claim 18 wherein said modulating means includes a variable orifice whereby the fluid passing area of said orifice may be varied in a nonlinear time-wise manner.

* * * * *